US005320232A

United States Patent [19]

Maguire et al.

[11] Patent Number: 5,320,232

[45] Date of Patent: Jun. 14, 1994

[54] POSITIVE-SEALING BOTTLE CAP

[76] Inventors: Paul R. Maguire, 4284 Sea View La., Los Angeles, Calif. 90065; John M. Lown, 222 La Jolla La., Newport Beach, Calif. 92663

[21] Appl. No.: 961,479

[22] Filed: Oct. 15, 1992

[51] Int. Cl.[5] ..... B65D 41/00

[52] U.S. Cl. ..... 215/245; 215/237; 215/352; 220/254; 220/335; 220/344

[58] Field of Search ..... 215/235, 237, 238, 244, 215/245, 352; 220/254, 263, 264, 335, 337, 338, 344

[56] References Cited

U.S. PATENT DOCUMENTS

| | | | |
|---|---|---|---|
| 1,471,195 | 10/1923 | Northern | 220/344 X |
| 1,534,836 | 4/1925 | Brede et al. | 220/344 X |
| 1,567,393 | 12/1925 | Schlaich | 220/344 X |
| 4,305,515 | 12/1981 | Tontarelli | 215/244 |
| 4,782,964 | 11/1988 | Poore et al. | 215/237 X |
| 4,809,874 | 3/1989 | Pehr | 220/338 |
| 5,031,784 | 7/1991 | Wright | 215/216 |
| 5,147,054 | 9/1992 | Pehr | 215/253 |

FOREIGN PATENT DOCUMENTS

| | | | |
|---|---|---|---|
| 2494227 | 5/1982 | France | 215/237 |

*Primary Examiner*—Allan N. Shoap
*Assistant Examiner*—Stephen Cronin
*Attorney, Agent, or Firm*—Harold L. Jackson

[57] ABSTRACT

An improved bottle cap device formed so as to have a positive sealing arrangement for use with bottles that store gaseous fluid such as soda water and like beverages, wherein the bottle cap device includes a threaded cap body and a hinged cover or lid that is formed having a sealing semi-spherical structure defined by a depending convex wall that engages a gasket mounted within the cap body when the cover is locked in a close sealed position.

22 Claims, 2 Drawing Sheets

POSITIVE-SEALING BOTTLE CAP

BACKGROUND OF THE INVENTION

The present invention relates to an improved bottle cap device and more particularly to a bottle cap that is formed having a positive sealing arrangement for use with bottles that store gaseous liquid such as soda water and like carbonated beverages. The bottle cap device includes a cap body and a sealing cover or lid that is formed having a depending semi-spherical sealing member that engages a gasket mounted within the cap body each time the cover is locked closed.

Many types of cap devices are presently in use and they vary in configuration and how they are capped on a bottle. This is generally due to the configuration of the bottle in which the soda is stored. Some known soda-bottle caps are just simple plastic snap-on units or caps having internal threads that match particular bottle arrangements and these caps have no particular sealing arrangement. Both of the types of caps do not provide proper sealing to prevent gases within the soda water from slowly leaking out. When the gas is allowed to escape from the bottled soda it is no longer desirable since it becomes what is referred to as "flat".

Therefore, such bottle caps generally have inherently poor sealing qualities. This is particularly true with bottle caps that are mounted to the larger 2 liter soda bottles commonly sold in markets, liquor stores, drug stores and like places. These bottles are often provided with soft aluminum caps that are fixedly sealed to the thread outlet neck portion of the bottle. This type of cap is removed from a bottle by rotating the cap so as to force it to break loose from an integrally formed holding ring member. Many times, the soft metal caps are distorted by the force required to remove them, causing the cap to lose its circular shape which then prevents it from being properly sealed, and allows the gases to leak out of the bottle.

Accordingly, there is a need for a sealing cap that is simple to operate and yet provides a very positive seal when remounted to me threaded neck portion of a 2 liter plastic bottle or other container.

SUMMARY OF THE INVENTION

The present invention comprises a novel bottle cap or cover member that is hingedly mounted to a cap body that is internally threaded so as to be readily secured to any compatible threaded neck portion of a soda bottle. The capping lid or cover is formed having an inverted semi-spherical wall structure that is adapted to engage a gasket member in a tight sealing manner which has not been provided heretofore. The gasket is formed to include an air vent or tube that is integrally formed therewith so as to extend downwardly within the neck of the bottle. A hinge device is provided between the snap lid or cover and the cap body, wherein a hinge is formed having a pivot pin that includes a latch arrangement which allows the lid to be held in an open position with respect to the cap body as the soda or other gaseous liquid is poured from the bottle.

Accordingly, it is an object of the present invention to provide an improved bottle cap that is particularly designed to be used with large plastic-type soda bottles and more particularly with 2 liter bottles that are provided with a screw cap. These bottles are commonly found in most stores today as they are used by most producers of various gaseous drinks from carbonated water to soda pop.

Another object of the invention is to provide an improved bottle cap that includes a unique sealing arrangement wherein the cover or lid is hingedly mounted to the cap body which is internally threaded so as to be screwed to the existing threads on the neck portion of the typical 2 liter soda bottle. The hinged lid is defined by an inverted dome-like wall structure so as to establish a positive sealing engagement with the inner annular sealing lip of the gasket member and the inner circular edge of the mouth of the bottle. This arrangement will automatically cause a positive aligned sealing engagement between the gasket and the inverted dome wall structure and the bottle mouth.

Still another object of the present invention is to provide a sealable and lockable lid having the above characteristics, whereby a positive sealing arrangement is provided to substantially extend the shelf life of stored bottled gaseous fluids well beyond that possible with any of the simple cap devices now employed for the same purpose.

A further object of the present invention is to provide a device of this character having few moving parts which makes it easy to use.

Still a further object of the invention is to provide a bottle cap device of this character that is relatively inexpensive to manufacture and is simple but rugged in construction.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

With the above and related objected in view, the invention consists in the details of construction and combination of parts, as will be more fully understood from the following description when read in conjunction with the accompanying drawings and numbered parts, in which.

DESCRIPTION OF THE PREFERRED EMBODIMENT

Figure 1:
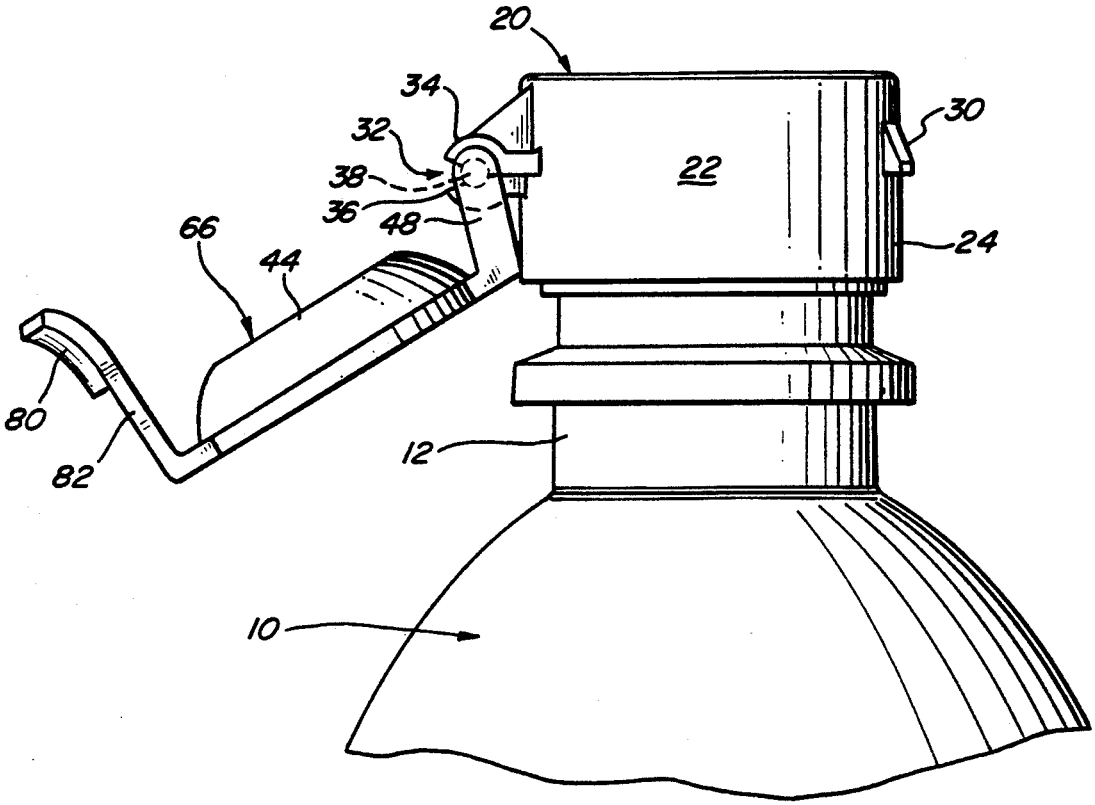
FIG. 1 is a front elevational view of the upper portion of a typical soda bottle on which there is illustrated the present invention that defines a bottle-sealing device having a hinged sealing lid or cover member which is shown in a secured open position on the cap body.
Figure 2:
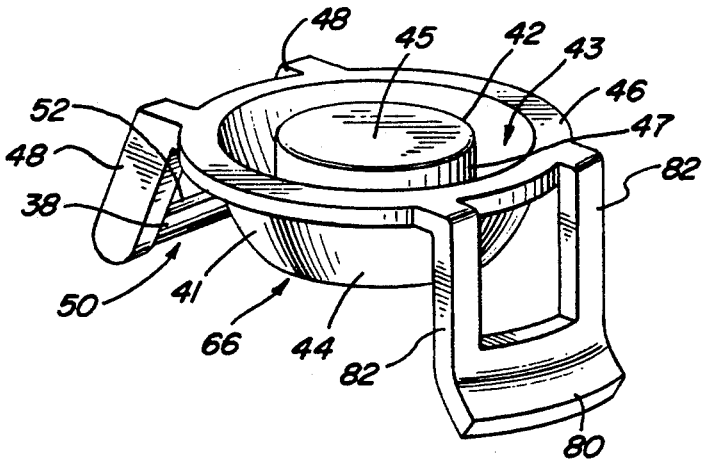
FIG. 2 is a perspective view of the sealing lid or cover showing it removed from the cap body member.

Referring more particularly to FIG. 1, there is shown an upper portion of a typical plastic soda bottle or other like bottle, generally indicated at 10, that is formed having a threaded neck portion 12. The soda bottle is the commonly used 2 liter size that has become a popular bottle size now available at most super markets and convenience stores. As previously mentioned, this type of bottle is provided with a sealed soft metal cap (not shown) that is threadably secured to threads 11 that are formed in the upper portion of neck 12 of the bottle 10. In the cross-section of FIG. 4, the neck portion 12 is shown with an annular outer wall member 14 that defines an opening or mouth 13 which includes an upper planer surface 13*a*, an inner circular edge 13*b* and an annular recess 15 that provides a shoulder 16. Just below shoulder 14 are receiving threads 11 formed in neck 12.

Figure 6:
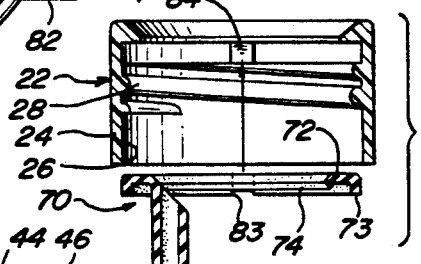
FIG. 6 is a cross-sectional view taken substantially along line 6—6 of FIG. 5 showing the gasket separated from the cap body member.
Figure 5:
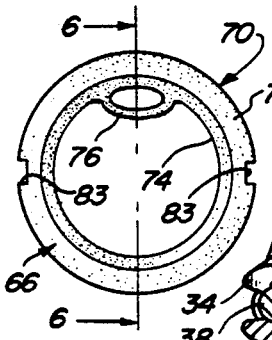
FIG. 5 is a top plan view of the gasket.
Figure 4:
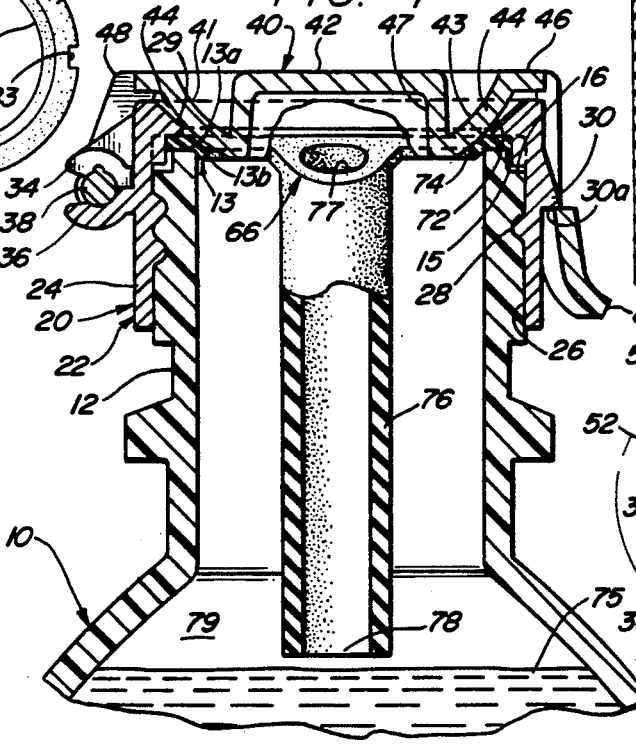
FIG. 4 is a cross-sectional view taken substantially along line 4—4 of FIG. 3 showing the cap body screwed to the threaded neck of the bottle.

Threadably mounted to threaded neck portion 12 is the present invention which is defined as a bottle cap device, generally designated at 20. Bottle cap device 20 is formed with a cap body 22, as seen in FIGS. 1, 4, and 6 which is defined by a cylindrical wall 24 having an inner surface 26 formed with internal threads 28. These threads are arranged to be threadably compatible with those of the bottle 10. The cap body defines an inwardly projecting shoulder 29 which is arranged to extend over the upper surface 13*a* of the mouth of the bottle and compress a gasket to be described against the surface 13*a* for sealing purposes. The outer surface of wall 24 of the cap is formed with a cap-locking means that is defined by an outwardly projecting hook 30. Also formed in wall 24 is a hinge means which is oppositely disposed to that of hook 30. The hinge means, designated generally at 32, comprises a pair of upper hinge arm members 34 that are spaced apart so as to accommodate a lower hinge arm member 36 which is positioned therebetween. Rotatably mounted between the upper and lower hinge arm members 34 and 36 is a pivot pin 38 which is formed as an integral part of a hinged sealing lid or cover 40.

Figure 3:
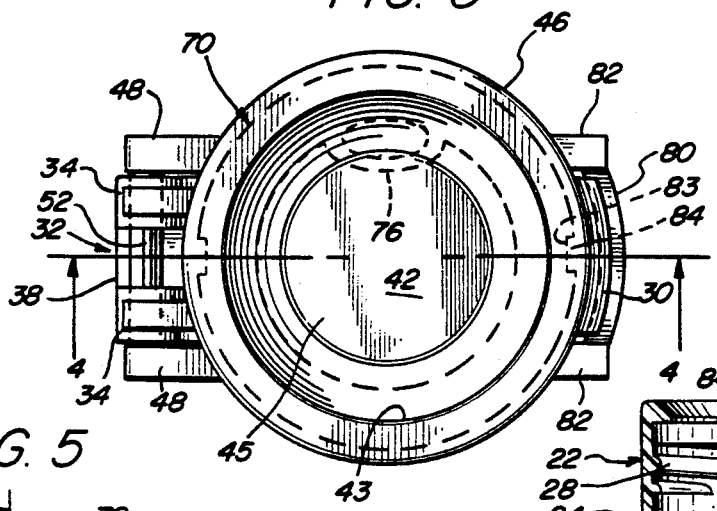
FIG. 3 is a top plan view of the bottle-sealing cap in a closed and locked position.
Figure 7:
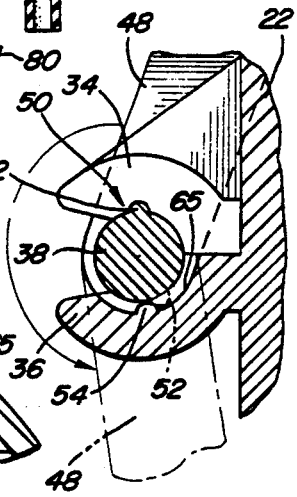
FIG. 7 is an enlarged cross-sectional view of the hinge connection of the sealing cap.

Cover lid 40 includes a top wall 42 which is formed having an annular V-shaped channel 43 defined by an outer curved wall 41 and an inner vertical wall 47, whereby curved wall 41 provides a convex semi-spherical gasket-engaging surface 44 which has the appearance of a section of an inverted dome member. Channel 43 further defines a central hub member 45 as part of top wall 42. An annular lip member 46 establishes the outer peripheral edge of cap 40 and covers the peripheral edge of body 22. A pair of leg members 48 are integrally connected to cover or lid 40 to which pivot pin 38 is fixedly mounted. It should be noted that pivot pin 38 is provided with a latch-positioning means, designated generally at 50, which comprises an elongated rib member 52 that is formed longitudinally along the upper side of pin 38 when sealing cap cover 40 is in a closed position, as seen in FIGS. 3, 4 and 7 Latch-positioning means 50 also includes a small projecting nipple member 54 (See FIG. 7) that is formed within the curved surface 65 of the lower arm 36. Cover 40 is thus rotatably mounted between arm members 34 and 36 so as to rotate therein between an open and closed sealed position, as illustrated in FIG. 4. That is, when the cover 40 is in a closed and locked position, as seen in FIGS. 4 and 7, rib member 52 is facing upwardly and is free to be rotated to an open position when cover lid 40 is unlocked To pour the fluid from the bottle, the cover or lid 40 is rotated rearwardly to the position as shown in FIG. 1 and is then latched in an open position as rib 52 overrides nipple 54 in lower arm member 36.

When in a sealed closed position, cover 40 and the semi-spherical sealing surface 44 is forced against a sealing means, designated at 66, which comprises a circular gasket 70 having an annular ring member 72 positioned between the shoulder 29 of the cap 40 and the upper surface 13*a* of the neck of the bottle as illustrated. The gasket includes an outer annular flange member 73 that is adapted to be positioned within recess 15, and an inner annular, inclined, sealing lip member 74 that is arranged in such a manner as to provide a very positive and stable seal when it is engaged with the convex semi-spherical gasket-engaging wall 44, thereby preventing gases in the soda water 75 from escaping through the neck of the bottle. The engaging lip member 74 of the gasket is compressed between the inner circular edge 13*a* of the mouth of the bottle and the curved wall 44 of the inverted dome member to provide a unique and positive seal. The configuration of the semi-spherical wall structure (44) of the cover lid 40, together with the overlapping of the inclined annular lip member 74, provides a self-adjusting sealing means for accommodating a misalignment between the upper surface of the bottle neck and the cap 40, not found in any known cap device. The self adjusting feature results, at least in part, because the surface of the semi-spherical wall 44 of the inverted dome member which engages the gasket lip is circular whether or not the plane of the top of lid 40 is parallel to the plane of the bottle mouth.

Integrally formed within the configuration of the circular gasket 70 is breathing tube 76 which is more specifically formed within the inclined lip member 74. Breathing tube 76 is formed having an inlet opening 77 and an outlet opening 78 which allow air to pass into the internal chamber 79 of the bottle, whereby the fluid stored therein will flow freely from bottle 10.

Accordingly, when the cover cap 40 is opened so as to remove soda 75 from the bottle, a locking means must be released This locking means comprises hook 30 that projects from body member 22 and a locking tongue 80 affixed to cap cover 40 by means of a pair of front leg members 82, as illustrated in FIGS. 1, 2, 3 and 4. As is illustrated in FIG. 4, the locking tongue 80 extends or snaps over the hook 30 and engages a lower shoulder 30*a* thereof in the locked and sealed position.

In order to prevent the breather tube from being misaligned from its normal position at right angles to the hinge means, a pair of oppositely disposed notches 83 are formed in depending flange 73 of gasket 70. These notches are aligned to receive respective tab members 84 which are formed on the inner surface 26 of cap body 22 and are located in direct longitudinal alignment with the cap hinge means and locking means, as seen in the top plan view of FIG. 3.

It may be thus seen that the objects of the present invention set forth herein, as those made apparent from the foregoing description are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A bottle cap device for sealing materials stored within a bottle container having a threaded neck portion, said bottle cap device comprising:

a cap body member having an annular wall with an outer surface and an inner surface, said inner surfaces being formed with threads whereby said bottle cap device for mounting to the threaded neck portion of the bottle;

a lid member;

a hinge means mounted between said lid member and said cap body member, whereby said lid member may be pivoted at said hinge means from a closed position to an open position;

locking means positioned between said lid member and said cap body member, whereby said lid member is held by said locking means in a sealed locked position;

a gasket mounted within said cap body member;

sealing means formed as part of said lid member so as to engage said gasket, whereby a positive seal is established between said sealing means and said gasket, the sealing means comprising a centrally disposed convex, semi-spherical gasket engaging surface; and means for latching said lid member in an open position.

2. A bottle cap device as recited in claim 1, wherein said gasket comprises a ring member having an outer annular flange member to seal the cap to the bottle and an inner annular sealing lip member, said sealing lip being positioned within said cap body for engagement with the semi-spherical gasket engaging surface of the sealing means.

3. A bottle cap device as recited in claim 2, wherein said gasket includes an air inlet means, whereby air may enter from the air inlet means as fluid from the bottle is being discharged therefrom.

4. A bottle cap device as recited in claim 3, wherein said air inlet means comprises an elongated tube member integrally formed with said gasket so as to extend downwardly into the neck portion of the bottle.

5. A bottle cap device as recited in claim 2, wherein said hinge means comprises:

a pair of spaced rear leg members integrally formed with said lid member, a pair of upper spaced arm members integrally formed with said cap body member being spaced apart from each other, a lower arm member integrally formed with said cap body member and mounted below and between said upper hinge arm members; and a pivot pin mounted between said leg members and positioned between said upper and lower arm members, whereby said lid member is rotatably mounted to said cap body member.

6. A bottle cap device as recited in claim 1, wherein said locking means comprises:

a hook member formed in said annular wall of said cap body member and projecting outwardly therefrom; and a locking tongue integrally affixed to said lid member so as to snap over said hook member when said lid member is placed in a closed sealed position over said cap body.

7. A bottle cap device as recited in claim 6, wherein said locking tongue includes a pair of flexible front leg members connected to said lid member.

8. A bottle cap device as recited in claim 7, wherein said bottle cap device includes means for positioning said gasket therein.

9. A bottle cap device as recited in claim 8, wherein said gasket-positioning means comprises:

an annular, outer, depending flange member formed on said gasket, said outer depending flange member having a pair of notches formed therein; and a pair of tab members formed in said inner surface of said annular wall of said cap body member so as to be received in said notches of said gasket, whereby said breathing tube is disposed in a selected position within said cap body member.

10. A bottle cap device as recited in claim 2, wherein said gasket includes an inner annular, inclined, sealing lip, said sealing lip being positioned to engage said convex sealing member formed as a depending semi-spherical wall.

11. A bottle cap device as recited in claim 2, wherein said means for latching said lid member in an open position comprises:

a longitudinal rib member formed along said pivot pin of said lid member; and a nipple member formed on said lower arm and positioned to engage said rib member as said lid member is rotated to a fully open position.

12. In combination with a bottle used for the storage of gaseous fluids of the type wherein the bottle is formed having a threaded discharge neck portion and a mouth formed by an upper planer surface with an inner edge, the improvement comprising:

a bottle cap having an annular cap body member with an open end and internal threads formed therein, whereby said bottle cap is threadably secured to the threaded neck portion of the bottle, the cap including an inwardly projecting shoulder arranged to extend over the upper planer surface of the bottle mouth;

a lid member hingedly attached to said body member for pivoting from an open to a closed position, the lid member having a downwardly projecting convex sealing surface whereby said open end of said body member is covered by the cap member in the closed position; and a gasket having an annular ring extending between the upper planer surface of the bottle mouth and the inwardly projecting shoulder of the cap body member to form a seal therebetween and a sealing lip member extending from the annular ring to form a seal between the inner edge of the bottle mouth and the downwardly projecting convex sealing surface on the lid member when the lid member is in a closed position.

13. The combination as recited in claim 12 wherein the cap body member has an annular wall and, further including locking means positioned between said lid member and said body member, the locking means comprising:

a hook member formed in said annular wall of said cap body member and projecting outwardly therefrom; and a resilient locking tongue integrally affixed to said lid member so as to snap over said hook member when said lid member is placed in a closed sealed position over said cap body.

14. The combination as recited in claim 13, wherein said gasket includes an air inlet means, whereby air enters the bottle from the air inlet means as fluid from the bottle is being discharged.

15. The combination as recited in claim 14, wherein said air inlet means comprises an elongated tube member; and wherein said hinge means comprises:

a pair of upper hinge members attached to said cover member, said upper hinge members being spaced apart from each other;

a lower hinge member mounted below and between said upper hinge members; and a pivot pin secured to said cover member, said pivot pin being mounted between said upper and lower hinge members, whereby said cover member is rotatably mounted to said body member.

16. The combination as recited in claim 13, wherein said locking tongue includes a pair of flexible front leg members connected to said lid member with a locking tongue extending between the terminal ends of the leg members.

17. The combination as recited in claim 12, wherein said convex sealing surface of said lid member is defined by a depending convex wall having a semi-spherical configuration that compresses the sealing lip member of said gasket against the inner edge of the mouth of the bottle when the cover is locked in a closed position.

18. The combination as recited in claim 12 wherein the sealing surface of the lid member comprises a semi-spherical surface for compressing the sealing lip member of the gasket against the inner edge of the bottle mouth when the lid member is in the closed position.

19. The combination of a bottle used for the storage of gaseous liquids of the type wherein the bottle is formed having a threaded discharge neck portion, and a bottle cap for closing the discharge neck portion, an improved bottle cap comprising:

an annular body member with an open end and internal threads formed therein, whereby said bottle cap is threadably secured to the threaded neck portion of the bottle; a cover member hingedly attached to said body member whereby said open end of said body member is covered;

a hinged means hingedly connecting said cover member and said body member, and including a latch-positioning means, whereby said cover member is held in an open position when the bottle is oriented to discharge liquid therein;

locking means positioned between said cover member and said body member, whereby said cover member is locked in a sealed position;

a gasket mounted within said cap body member; and a convex sealing member defining a sealing means formed as part of said cover member so as to engage said gasket whereby a positive seal is established therebetween.

20. The combination as recited in claim 19, wherein said gasket comprises a ring member having an outer annular, depending flange member and an inner angularly depending lip member, said lip member being positioned within said body member to engage said convex sealing member of said cover member.

21. In combination with a bottle of the type wherein the bottle is formed with a discharge neck portion having external threads and an upper planar surface and an inner edge at the mouth of the bottle, an improved bottle cap for selectively opening and closing the neck portion comprising:

a cap body member having an annular wall with an outer surface, an inner surface and an inwardly projecting surfaces for extending over the upper planar surface of the mouth of the bottle, the inner surface being formed with threads for mounting to the threaded neck portion of the bottle;

a lid member hinged to the cap body member for rotation between a closed and an open position;

cooperating locking means mounted on the lid member and the cap body member, whereby the lid member may be secured by the locking means in a sealed and locked position;

a gasket mounted within the cap body member, the gasket including an annular ring member extending between the inwardly projecting surface of the cap body member and the upper planar surface of the bottle neck and a sealing lip member extending inwardly from the annular ring member; and a semi-spherical sealing surface formed as part of the lid member for compressing the sealing lip member of the gasket against the inner edge of the mouth of the bottle in the closed position.

22. The combination as recited in claim 21 wherein the locking means comprises:

a hook member formed in said annular wall of said cap body member and projecting outwardly therefrom; and a resilient locking tongue integrally affixed to said lid member so as to snap over said hook member when said lid member is placed in a closed sealed position over said cap body.

* * * * *

UNITED STATES PATENT AND TRADEMARK OFFICE

CERTIFICATE OF CORRECTION

PATENT NO. : 5,320,232

DATED : June 14, 1994

INVENTOR(S) : Paul R. Maguire and John M. Lown

It is certified that error appears in the above-identified patent and that said Letters Patent is hereby corrected as shown below:

Column 3, line 60, after "7" insert --.--.

Column 4, line 2, after "locked" insert --.--.

Column 4, line 45, after "released" insert --.--.

Column 8, line 23" delete "surfaces" and insert --surface--.

Signed and Sealed this

Sixth Day of September, 1994

*Attest:*

Bruce Lehman

BRUCE LEHMAN

*Attesting Officer*

*Commissioner of Patents and Trademarks*